US006666187B2

(12) United States Patent
Dahlberg et al.

(10) Patent No.: US 6,666,187 B2
(45) Date of Patent: Dec. 23, 2003

(54) DEVICE FOR ADJUSTABLY LIMITING THE ENGINE SPEED OF A HAND TOOL

(75) Inventors: Göran Dahlberg, Gränna (SE); Bo Sandström, Mullsjö (SE); Mats Axelsson, Huskvarna (SE); Marcus Kragner, Huskvarna (SE)

(73) Assignee: Aktiebolaget Electrolux, Stockholm (SE)

( * ) Notice: Subject to any disclaimer, the term of this patent is extended or adjusted under 35 U.S.C. 154(b) by 124 days.

(21) Appl. No.: 10/034,170

(22) Filed: Dec. 27, 2001

(65) Prior Publication Data

US 2002/0088431 A1 Jul. 11, 2002

(30) Foreign Application Priority Data

Jan. 11, 2001 (SE) ..... 0100093

(51) Int. Cl.[7] ..... F02D 11/02
(52) U.S. Cl. ..... 123/398; 74/501.6; 123/396
(58) Field of Search ..... 123/396, 398, 123/400; 30/276; 56/11.3; 74/491, 501.6

(56) References Cited

U.S. PATENT DOCUMENTS

| | | | | |
|---|---|---|---|---|
| 3,724,287 A | * | 4/1973 | Dreeben | 74/526 |
| 4,016,842 A | * | 4/1977 | Kittler | 123/396 X |
| 4,108,120 A | | 8/1978 | Woelffer | 123/337 |
| 4,807,580 A | * | 2/1989 | Clark | 123/398 |
| 6,006,627 A | * | 12/1999 | Ikeda et al. | 74/501.6 X |

* cited by examiner

*Primary Examiner*—Tony M. Argenbright
(74) *Attorney, Agent, or Firm*—Pearne & Gordon LLP

(57) ABSTRACT

The invention relates to a device for adjustably limiting the maximum speed of an engine powered hand tool controlled by a power-regulating device (11) located in the handle of the tool. The device makes it possible to optimise the speed of the engine for the job that is to be done. The device consists of a threaded shaft (15) that is moved by rotating a nut (12) and a spring (14). When a higher speed than the selected level is required, is it possible to increase the speed to the maximum speed available by pressing the power-regulating device (11) with a force that exceeds the force from the spring (14).

9 Claims, 5 Drawing Sheets

DEVICE FOR ADJUSTABLY LIMITING THE ENGINE SPEED OF A HAND TOOL

BACKGROUND OF THE INVENTION

This invention relates to a device for adjustably limiting the maximum speed of an engine powered hand tool whose speed is controlled by a power-regulating device located in the handle of the tool.

While using engine powered portable hand tools, it is convenient to allow the engine to run at a constant speed that is less than the engine's maximum speed. By running the engine at a constant speed, the performance of the tool is improved and the load and wear on the engine is reduced. Operator comfort is also increased when the engine is run at a constant speed.

Hand held tools with engine speed limiting devices are available as are hand tools with handles that contain several different buttons to control different functions of the tool. For example, a handle with buttons for steering of the tool is illustrated in EP0968641. The handle described in EP0968641 has a power regulating device and a safety button, but the handle as described in EP0968641 does not allow the operator to limit the speed of the engine in order to make it possible for the operator to run the engine at a constant speed that is less than the maximum speed of the engine.

During use of the hand tool, is it desirable to increase the speed of the engine above the selected speed limit. This could, for example, be required when the amount of grass or bushes to be trimmed by the operator are higher than normal in a concentrated area. In these cases, it is not effective to limit the speed of the engine, and it is necessary to increase the speed of the engine to the maximum speed available to enable the operator to cut the concentrated area.

BRIEF SUMMARY OF THE INVENTION

This invention achieves an increased speed for the engine above a selected speed limit. Under normal operation, an adjustable speed limiting device will stop the power-regulating device at the selected speed. However, if the operator needs to increase the speed of the engine above the selected limit, the operator can accomplish this by exerting an additional force on the power-regulating device. The adjustable speed limiting device will then be deactivated and the speed of the engine will be allowed to increase. The operator may then increase the speed of the engine up to the maximum engine speed.

BRIEF DESCRIPTION OF THE DRAWINGS

An embodiment of the invention will now be described with reference to the accompanying figures in which.

DETAILED DESCRIPTION OF THE INVENTION

Figure 1:
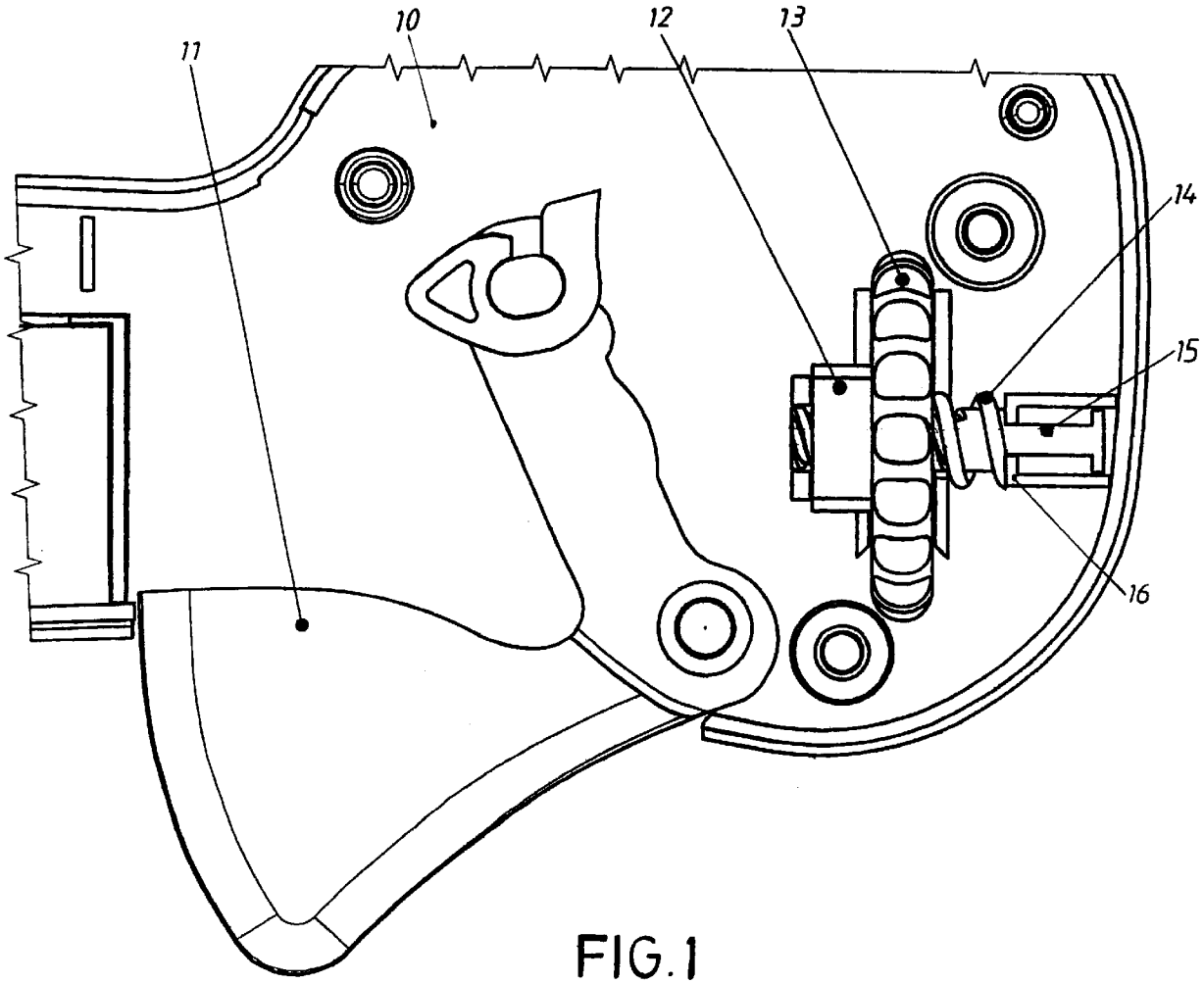
FIG. 1 illustrates a device for adjustably limiting the maximum speed of an engine powered hand tool including an adjustable wheel located inside the handle of the tool for setting the engine speed.

The device, as shown in FIG. 1, is incorporated into a hand tool handle that contains a casing 10 that surrounds the different parts that are needed in order to control and steer the different functions of the tool. The handle comprises a power-regulating device 11, a button for adjusting the limitation of speed for the engine and a control that stops the engine. Inside the casing 10 are all the different parts that are needed to steer the different functions of the tool and connect the buttons on the handle with the appropriate part of the tool.

Figure 2:
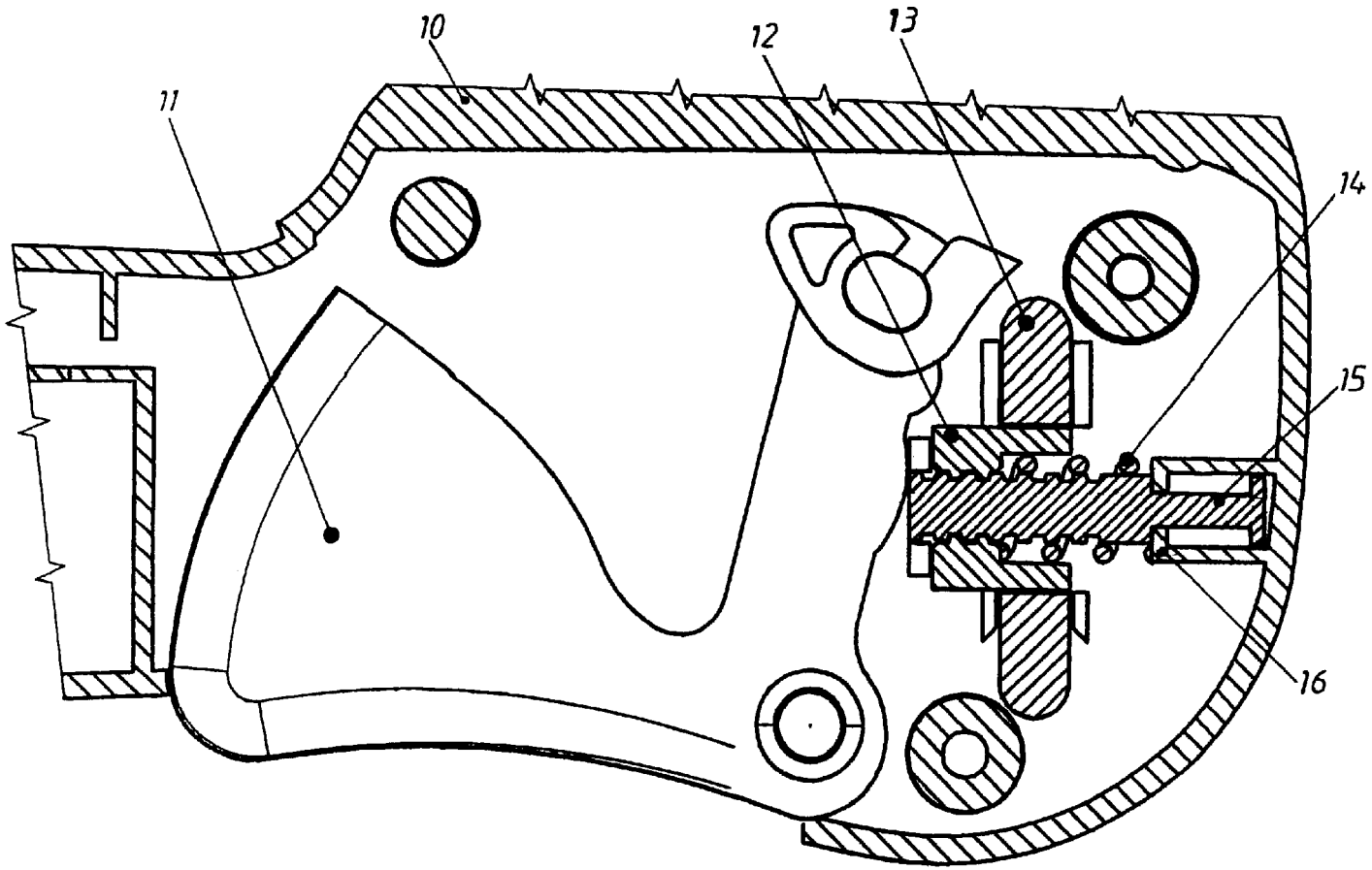
FIG. 2 illustrates a cross section of the tool handle showing the speed limiting device not activated.

Referring to FIG. 2, the button for adjusting the limitation level for the power regulating device 11 is shaped like a wheel 13 and placed in the top of the handle where it is easy for the operator to reach it with their thumb. The wheel 13 is attached to the handle so that the wheel 13 can be rotated, but not moved in an axial direction relative the casing 10. In the center of the wheel 13, a nut 12 is placed. The nut 12 is provided with either two protruding parts or two grooves, one on each side of the nut, running in the axial direction of the nut 12. The inside of the wheel 13 that is in contact with the nut 12 is provided with corresponding protruding parts or grooves, such that the nut can slide in an axial direction in the center of the wheel 13. The protruding parts will steer the nut 12 in the wheel 13.

The nut 12 is placed on a threaded shaft 15 and shaped such that a spring 14, for example a helical spring, placed around the threaded shaft 15 is in contact with one side of the nut 12. The nut 12 is provided with an opening that matches the diameter of the spring 14. One end of the spring 14 is fastened in the nut 12 and the other end to support 16 located on the inside of casing 10. The threaded shaft 15 is attached to the casing 10 in such a way that it is movable in an axial direction and within a selected range.

Figure 3:
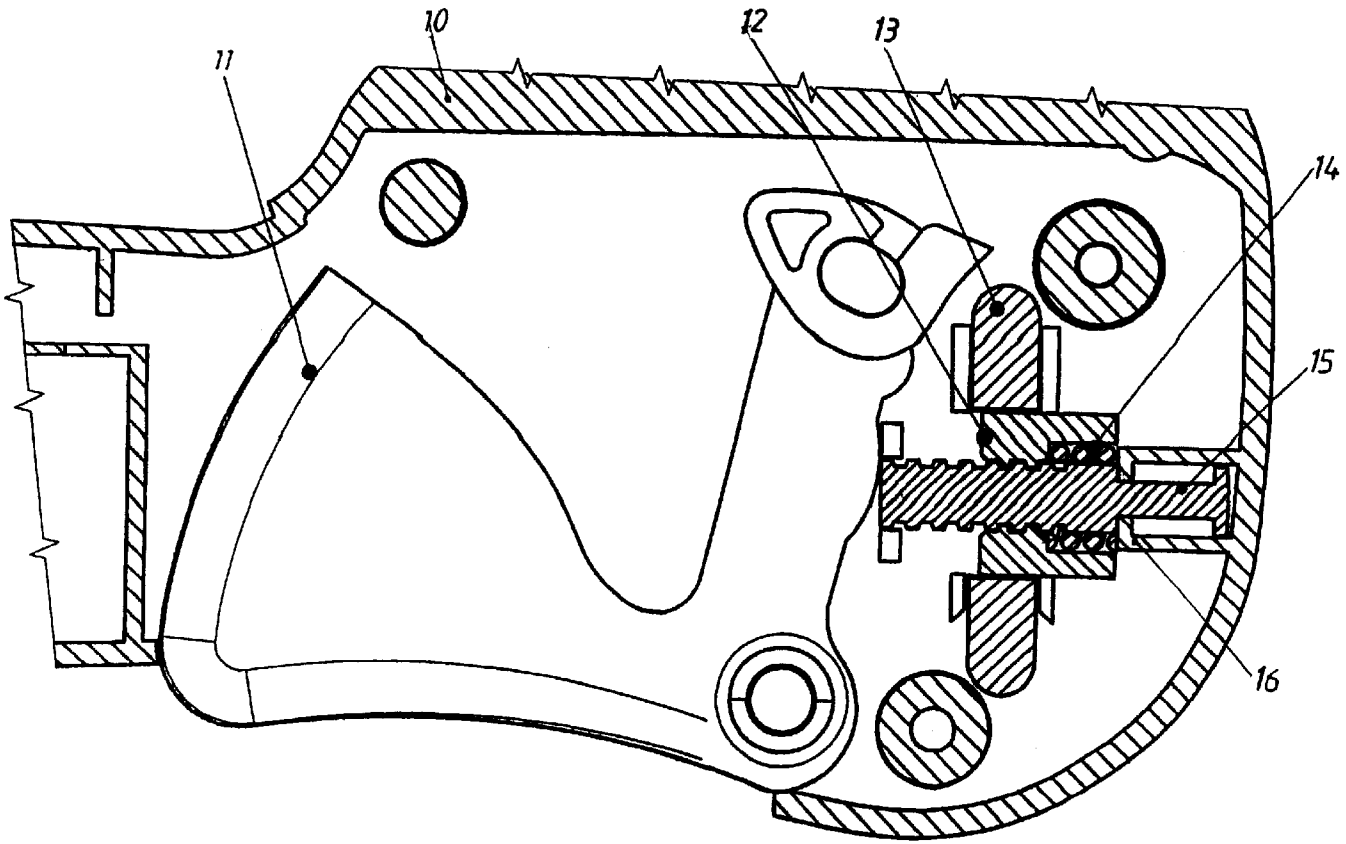
FIG. 3 illustrates a cross section of the tool handle with the speed limiting device activated and in a maximized position.

As shown in FIG. 3, the threaded shaft 15 is at the end of its range and as close as possible to the inside of the casing 10. In this position, the threaded shaft 15 is an obstacle that stops the power regulating device 11 from being pushed any further inward, limiting the operator's ability to increase the speed of the engine to its maximum speed.

Figure 4:
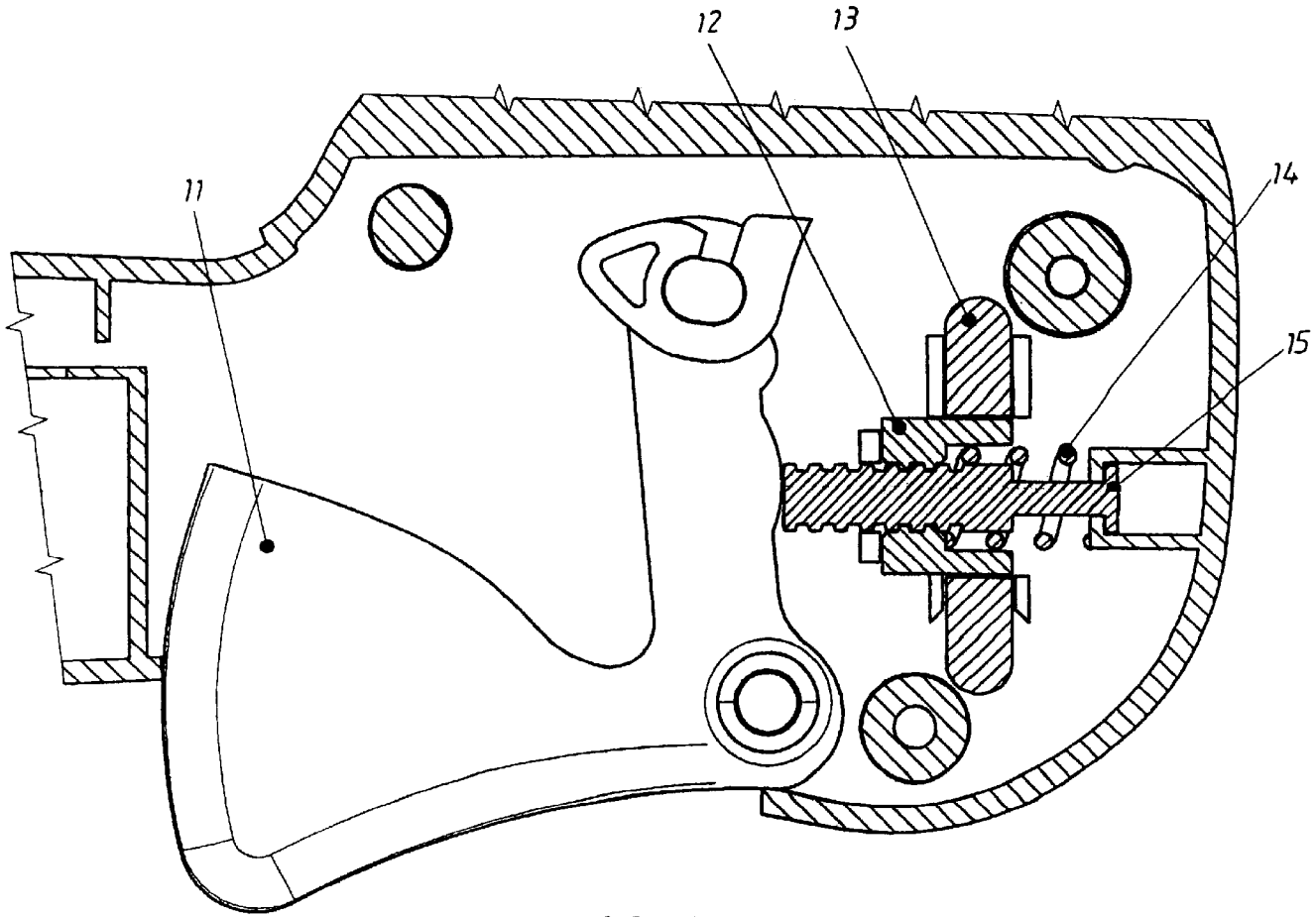
FIG. 4 illustrates a cross section of the tool handle with the speed limitation device activated and the power regulating device stopped at a selected speed limiting position.

Referring now to FIG. 4, because of the threads on the shaft, when the wheel 13 and the nut 12 are rotated, the threaded shaft 15 moves in an axial direction in nut 12. This movement of the threaded shaft 15 results in the shaft blocking the power-regulating device 11 at a selected point from further movement. If the operator wants to increase the speed over this selected level, the operator must press the power regulating device 111 with a force that exceeds the force of spring 14 that supports nut 12. By doing so, nut 12 will slide in wheel 13 and threaded shaft 15 will move backward towards the inside of casing 10 and the speed of the engine will allowed to increase above the selected level and to its maximum level.

Figure 5:
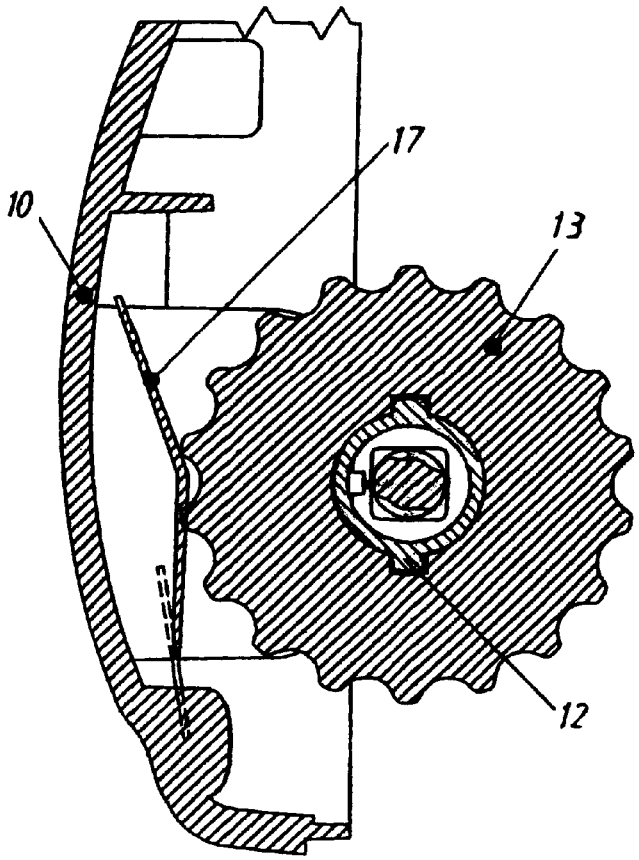
FIG. 5 illustrates a cross section of the tool handle including a device that prevents unintentional rotation of the wheel.

As shown in FIG. 5, to prevent wheel 13 and nut 12 from unintended rotation, a device 17 is attached in casing 10 and is in contact with a portion of the outer surface of wheel 13. The device 17 retains wheel 13 in a selected position such that there will be no unintended change to the selected speed setting.

What is claimed is:

1. A device for adjustably limiting the maximum speed of an engine powered hand tool comprising a power-regulating device (11) located in the casing (10) of the tool handle, a threaded shaft (15) cooperating with the power-regulating device (11), and a spring (14) placed around the threaded shaft (15) characterised in that the maximum speed of the engine can be obtained by pressing the power-regulating device (11) with a force greater than the force exerted by the spring (14).

2. A device according to claim 1, characterised in that the threaded shaft (15) is movable in an axial direction by a nut (12) and a wheel (13) on the handle.

3. A device according to claim 2, characterised in that the wheel (13) is shaped to match the thumb of an operator.

4. A device according to claim 2 or 3, characterised in that the adjustment of the limitation for the speed of the engine is done by rotation of the wheel (13) on the handle such that the position of the threaded shaft (15) in relation to the power-regulating device (11) is changed.

5. A device according to claim 2, characterised in that the spring (14) acts between the nut (12) and a support (16) on the inside of the casing (10).

6. A device according to claim 5, characterised in that the spring (14) is a helical spring placed around the threaded shaft (15).

7. A device according to claim 2, 5 or 6, characterised in that the outer side of the nut (12) is provided with protruding parts or grooves running in the axial direction along the nut (12) and that the inside on the wheel (13) that surrounds the nut (12) is provided with grooves or protruding parts that correspond to the protruding parts or grooves on the nut (12) such that the nut (12) can slide in an axial direction relative to the wheel (13).

8. A device according to claim 2 or 3, characterised in that the handle is provided with a device (17) in contact with the outer surface of the wheel (13) in order to keep the wheel (13) in a selected position.

9. A device according to claim 4, characterised in that the handle is provided with a device (17) in contact with the outer surface of the wheel (13) in order to keep the wheel (13) in a selected position.

* * * * *